US011346022B2

(12) United States Patent
Keil

(10) Patent No.: US 11,346,022 B2
(45) Date of Patent: May 31, 2022

(54) METHOD FOR STARTING A SPINDLE OF A CABLING OR TWO-FOR-ONE TWISTING MACHINE

(71) Applicant: Saurer Technologies GmbH & Co. KG, Krefeld (DE)

(72) Inventor: Andreas Keil, Krefeld (DE)

(73) Assignee: Saurer Technologies GmbH & Co. KG, Krefeld (DE)

( * ) Notice: Subject to any disclaimer, the term of this patent is extended or adjusted under 35 U.S.C. 154(b) by 0 days.

(21) Appl. No.: 15/615,905

(22) Filed: Jun. 7, 2017

(65) Prior Publication Data

US 2018/0016711 A1 Jan. 18, 2018

(30) Foreign Application Priority Data

Jul. 15, 2016 (DE) ..... 10 2016 008 621

(51) Int. Cl.

| | |
|---|---|
| ***D01H 1/10*** | (2006.01) |
| ***D02G 3/28*** | (2006.01) |
| ***D01H 7/86*** | (2006.01) |
| *D01H 15/007* | (2006.01) |

(52) U.S. Cl.

CPC ..... *D01H 1/101* (2013.01); *D01H 7/86* (2013.01); *D02G 3/285* (2013.01); *D02G 3/286* (2013.01); *D01H 1/103* (2013.01); *D01H 1/105* (2013.01); *D01H 1/106* (2013.01); *D01H 1/108* (2013.01); *D01H 7/866* (2013.01); *D01H 7/868* (2013.01);

(Continued)

(58) Field of Classification Search

CPC ..... D01H 1/10; D01H 1/101; D01H 1/103; D01H 1/105; D01H 1/106; D01H 1/108; D01H 7/86; D01H 7/866; D01H 7/868; D01H 15/007; D02G 3/285; D02G 3/286; D02G 3/288; D02G 3/283

USPC ..... 57/58.83, 264, 78

See application file for complete search history.

(56) References Cited

U.S. PATENT DOCUMENTS 2,864,230 A * 12/1958 Moore, Jr. ..... D01H 5/36 57/6

2,870,596 A * 1/1959 Vibber ..... D01H 13/104 57/58.83

(Continued)

FOREIGN PATENT DOCUMENTS

DE 10 2007 043 352 A1 3/2009

*Primary Examiner* — Alissa J Tompkins

*Assistant Examiner* — Dakota Marin

(74) *Attorney, Agent, or Firm* — Nelson Mullins Riley & Scarborough LLP

(57) ABSTRACT

A method for starting a spindle of a cabling or two-for-one twisting machine, wherein a yarn reserve is formed on a take-up package, the machine has a workstation having a spindle pot for holding a first feed package and having a spindle rotor with a lateral outlet below the spindle pot, an outer yarn from one feed package is wound around an inner yarn from another feed package and the outer yarn is guided through the spindle shaft and its lateral outlet in a balloon orbiting the spindle pot to a yarn-guiding device above the spindle which merges the two yarn supplies, and a winding device in which the produced twist is wound onto the take-up package. A ratio of the take-up speed of the twist to the rotation speed of the spindle rotor is increased in comparison with the production data is used during creation of the yarn reserve.

3 Claims, 4 Drawing Sheets

(52) U.S. Cl.
CPC ..... *D01H 15/007* (2013.01); *D02G 3/283* (2013.01); *D02G 3/288* (2013.01)

(56) References Cited

U.S. PATENT DOCUMENTS 2,914,906 A * 12/1959 Place et al. ..... D02G 1/18 57/351
2,949,725 A * 8/1960 Renzini ..... D02G 3/285 57/348
3,017,738 A * 1/1962 Beyer ..... D02G 3/285 57/332
3,357,655 A * 12/1967 Iwnicki ..... D01H 1/00 242/159
3,788,055 A * 1/1974 Gabalda ..... D01H 7/864 57/58.72
3,810,353 A * 5/1974 Petersen ..... D01H 13/08 57/58.83
5,329,755 A * 7/1994 Frentzel-Beyme .... D01H 1/425 57/354
5,706,642 A * 1/1998 Haselwander ..... D01H 1/10 57/264
2003/0159424 A1* 8/2003 Nakashima ..... D01H 13/108 57/314
2003/0200739 A1* 10/2003 Fernandez ..... D02G 3/28 57/58.36
2003/0209001 A1* 11/2003 Schacht ..... D01H 7/86 57/58.83
2008/0308664 A1* 12/2008 Vega ..... B65H 59/384 242/364.7
2011/0016840 A1* 1/2011 Rittenhouse ..... D01H 9/18 57/76
2011/0126506 A1* 6/2011 Schlagenhaft ..... D02G 3/285 57/58.86

* cited by examiner

METHOD FOR STARTING A SPINDLE OF A CABLING OR TWO-FOR-ONE TWISTING MACHINE

CROSS-REFERENCE TO RELATED APPLICATIONS

This application claims priority from German National Patent Application No. DE 10 2016 008 621.1, filed Jul. 15, 2016, entitled "Verfahren zum Starten einer Spindel einer Kablier-oder Doppeldrahtzwirnmaschine", the entire contents of which are incorporated herein by reference.

FIELD OF THE INVENTION

The invention relates to a method for starting a spindle of a cabling or two-for-one twisting machine at the start of a spindle journey, and more particularly to such a method wherein a yarn reserve is formed on an empty take-up package outside of the winding zone, wherein the cabling or two-for-one twisting machine has at least one workstation, each workstation having a spindle pot at rest during twisting for holding an initial feed package and having a rotating, hollow spindle rotor, which has a lateral outlet opening arranged below the spindle pot at a distance from the spindle hollow shaft, wherein an outer yarn pulled from a second feed package is wound around an inner yarn pulled from a first feed package and wherein the outer yarn is guided through the spindle hollow shaft and through the lateral outlet opening thereof and in a yarn balloon orbiting the spindle pot to a yarn-guiding device, which is arranged above the spindle in extension of the spindle shaft and which merges the two yarn supplies, and a winding device having a yarn guide is present, in which winding device the produced twist is wound onto the take-up package.

BACKGROUND OF THE INVENTION

Twisting or cabling or cording is a mechanical yarn-finishing method for producing certain usage properties in the twisted yarn. While two or more yarns are merged into a twisted yarn by twisting in the two-for-one twisting method, cabling is a special twisting method in which two yarns are twisted together without the individual yarns themselves receiving a twist. The advantage of twisting lies in the higher tensile strength, because the individual filaments always lie exactly in the loading direction.

In the context of the present application, the term "yarn" encompasses all linear constructions, such as yarns, film bands, tubular and strip-shaped textiles and the like. For simplification, the term "yarn" is used to mean the possible alternatives in the context of the present application.

A cabling machine, for example, typically has a plurality of workstations arranged adjacent to each other in the machine longitudinal direction. The workstations each comprise a spindle, onto which a feed package is slid, and a slide-on device, which is arranged on the machine frame and which serves to hold a second feed package. The yarns are pulled from the feed packages and kept at constant tension by yarn brakes, cabled and wound onto a package in a winding unit. In general in the case of twisting, the more twists the finished twisted yarn should have, the lower the take-up speed is at a specified spindle rotational speed.

At the start of a new batch, twisting must be started; i.e. new feed packages are positioned in the creel and in the spindle pots of the individual workstations. The yarns are appropriately threaded into the yarn-guiding elements, guided to the winding unit and fastened to an end of an empty tube. In this area, a yarn reserve required for subsequent processes is created outside of the actual winding zone.

During the operation of the cabling spindle, the first feed package is arranged on the rotating spindle in a spindle pot. However, the spindle pot and the feed package itself are secured against rotation. A so-called inner yarn is pulled axially upward from said first feed package and, on the way to the point of cabling or point of combination with the outer yarn, is led through an inner yarn brake.

The second feed package, from which the outer yarn is pulled, is arranged in a creel. After the outer yarn has passed an outer yarn brake and optionally a deflecting device, the outer yarn enters the hollow spindle axially from below and exits the spindle at a storage disc. The outer yarn rotates around the spindle pot, a yarn balloon being formed, and is led to the balloon yarn guide. At this location, the outer yarn is wound around the inner yarn, and therefore this is also called the point of cabling.

German Patent Publication DE 10 2007 043 352 A1 discloses a cabling machine and a method for operating said cabling machine. In order to produce a package having a specified weight, the first feed package, which is inserted into the spindle pot, is selected in such a way that the first feed package has half the weight of the package to be produced. The second feed package, which is positioned in the creel, is selected in such a way that the second feed package corresponds at least to the total weight of the package to be produced. By means of this procedure, the operating effort and the number of residual feed packages are reduced. In practice, it is very common that all workstations start simultaneously and therefore also end approximately at the same time.

However, a disadvantage of this method according to the prior art is that yarn breaks often occur as the cabling spindles run up to the operating rotational speed thereof. This occurs with greater frequency especially when yarns having a high number of individual filaments and/or composed of friction-sensitive material such as polypropylene or polyester are used for twisting.

Because of machine-long drives for the cabling spindles, there is an overall negative effect on the efficiency of such cabling machines when yarn breaks occur frequently at workstations.

SUMMARY OF THE INVENTION

Therefore, proceeding from the prior art mentioned above, the problem addressed by the invention is that of reducing the number of yarn breaks during the run-up.

The invention is applicable to methods for starting a spindle of a cabling or two-for-one twisting machine at the start of a spindle journey, wherein a yarn reserve is formed on an empty take-up package outside of the winding zone, wherein the cabling or two-for-one twisting machine has at least one workstation, each workstation having a spindle pot at rest during the twisting for holding a first feed package and having a rotating, hollow spindle rotor, which has a lateral outlet opening arranged below the spindle pot at a distance from the spindle hollow shaft, wherein an outer yarn pulled from a second feed package is wound around an inner yarn pulled from a first feed package and wherein the outer yarn is guided through the spindle hollow shaft and through the lateral outlet opening thereof and in a yarn balloon orbiting the spindle pot to a yarn-guiding device, which is arranged above the spindle in extension of the spindle axis and which merges the two yarn supplies, and a winding device having a yarn guide is present, in which winding device the produced twist is wound onto the take-up package.

According to the invention, the aforementioned problem is solved by providing a ratio of the take-up speed of the twist to the rotation speed of the spindle rotor that is increased in comparison with the production data is used during the creation of the yarn reserve.

Advantageous additional features and embodiments of the invention are also disclosed.

Because of this procedure, the time during which the outer yarn touches the spindle pot until the formation of the yarn balloon is reduced. Until the spindle rotor has reached the production speed during the start of the spindle and the outer yarn exits the spindle rotor sufficiently quickly in order to be able to form the yarn balloon around the spindle pot, the outer yarn typically touches the spindle pot because of the lower yarn speed. During the start, touching of the spindle pot generally initially occurs over a relatively long distance, wherein the points at which the outer yarn also experiences a deflection are most critical, i.e., at the upper and/or the lower edge of the spindle pot, wherein the latter occurs only in the case of spindle pots that are conically drawn in at the bottom. Contact with the cabling hood can possibly also occur.

In the twisting process, there is a direct relationship between the number of twists that the finished twist should have and the take-up speed at which the twist is wound onto the take-up package. The delivery speed must be set lower, because the spindle rotational speed cannot be increased.

If the ratio of the take-up speed to the rotating spindle rotor is increased in comparison with the production conditions, the friction time of the outer yarn on the spindle pot is reduced. Because the friction loading of the outer yarn on the particular spindle pot edge occurs for a shorter time, the outer yarn is damaged less and fewer yarn breaks occur during the start.

This is especially advantageous for twists that are produced from yarns having many individual filaments and/or friction-sensitive material. The more individual filaments contained in the yarn, the greater the surface of the yarn with respect to a yarn segment and the more friction that occurs. Because the yarn reserve is generally wound onto the take-up package outside of the actual production region and, in the further processing of the packages, is used to tie the following package to the preceding package in the creel, this start or end region of the packages does not enter into the production of the later processing operations. For this reason, it is harmless if the yarn reserve has considerably fewer twists than the actual twist under production conditions.

According to the invention, the method according to the invention can be applied both to cabling machines and two-for-one twisting machines that have a plurality of workstations arranged adjacent to each other in the machine longitudinal direction and to so-called single spindle units. Furthermore, the method according to the invention can be applied both to spindles/winding devices driven machine-long and to spindles/winding devices that have an individual drive.

According to another aspect of the invention, the take-up speed is advantageously increased during the creation of the yarn reserve in comparison with the take-up speed under production conditions.

In a particularly simple manner, the ratio of the take-up speed to the rotation speed of the spindle rotor can be increased by winding the yarn reserve onto the take-up spindle at a higher take-up speed while the spindle rotational speed remains constant. While the spindle is accelerated to 100% of the target rotational speed during the spindle start, the take-up speed is 100% plus x. After a time that can be selected accordingly, the take-up speed is lowered to 100% of the target speed.

The number of rotations is reduced approximately by the factor by which the take-up speed is increased.

In a preferred embodiment of the invention, the run-up of the spindle rotor occurs with at least an acceleration increased by the factor of 1.2 during the creation of the yarn reserve.

The stationary spindle or the spindle rotor must be accelerated from standstill up to the production speed. This so-called run-up is performed with a specified acceleration. Until now, the acceleration and the run-up ramp resulting therefrom were performed identically for different events. That is, regardless of whether there was a new start of a batch or a restart, for example after a yarn break, the spindle rotor was accelerated to the operating rotational speed with identical parameters.

Because of faster acceleration of the spindle rotor and a shortened run-up ramp resulting therefrom, the yarn balloon of the outer yarn around the spindle pot is formed so quickly that the friction of the outer yarn at the critical points is reduced.

BRIEF DESCRIPTION OF THE DRAWINGS

The invention is explained in greater detail below on the basis of an embodiment example, with reference to the accompanying drawings, wherein.

DETAILED DESCRIPTION OF THE INVENTION

Figure 1:
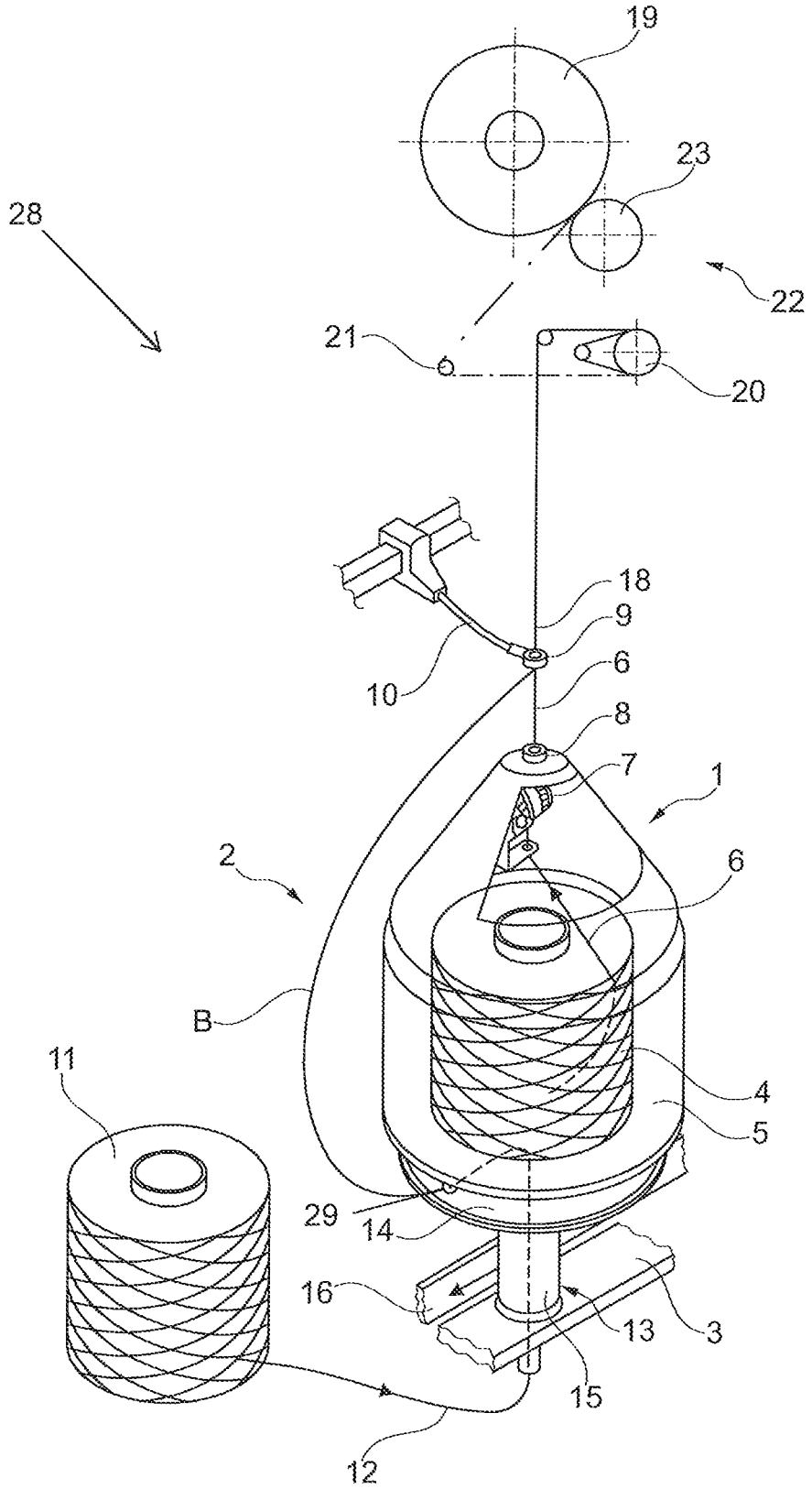
FIG. 1 depicts a schematically presented workstation of a cabling machine.

In FIG. 1, a schematic view of the structure of a workstation of a cabling machine is shown. The cabling spindle 2 is supported on a spindle rail 3. A first feed package 4 is in the spindle pot 5 of the cabling spindle 2. Overhead, the inner yarn 6 is pulled from the first feed package 4 and led through a yarn brake 7 arranged in the cabling hood 1. After the yarn brake 7, the inner yarn 6 exits the cabling hood 1 through a yarn guide eye 8 and finally passes through a downstream yarn-guiding device, here a balloon yarn guide eye 9. The balloon yarn guide eye 9 is fastened by means of a retainer 10 to the machine frame, which is only intimated. Instead of the balloon yarn guide eye 9, a so-called cord regulator, for example, can also be present.

A second feed package 11 is typically supported on a slide-on device arranged on the machine frame and is shown adjacent to the cabling spindle 2 only schematically here. The outer yarn 12 pulled from the second feed package 11 passes through the spindle hollow shaft 13 from below, is deflected in the radial direction and exits radially at the yarn storage disc 14. The yarn storage disc 14 is rotationally driven by a drive belt 16 by means of a spindle whorl 15.

Exiting from the yarn storage disc 14 and forming a yarn balloon B, the outer yarn 12 is led on the outside of the spindle pot 5 upward to the balloon yarn guide eye 9. Here, the outer yarn 12 is wrapped around the inner yarn 6 and the twist 18 produced in this way is wound further onto a take-up package 19. That is, the point of cabling, at which the inner yarn 6 and the outer yarn 12 merge and form the yarn or cord yarn 18, is located in the balloon yarn guide eye 9 or the balancing system.

A pull-off device 20 is arranged above the point of cabling, by means of which the twist 18 is pulled off and fed via a balancing element, such as a dancer 21, to a winding device 22. The winding device 22 has a drive roller 23 and a take-up package 19 frictionally driven by the drive roller 23.

Figure 2:
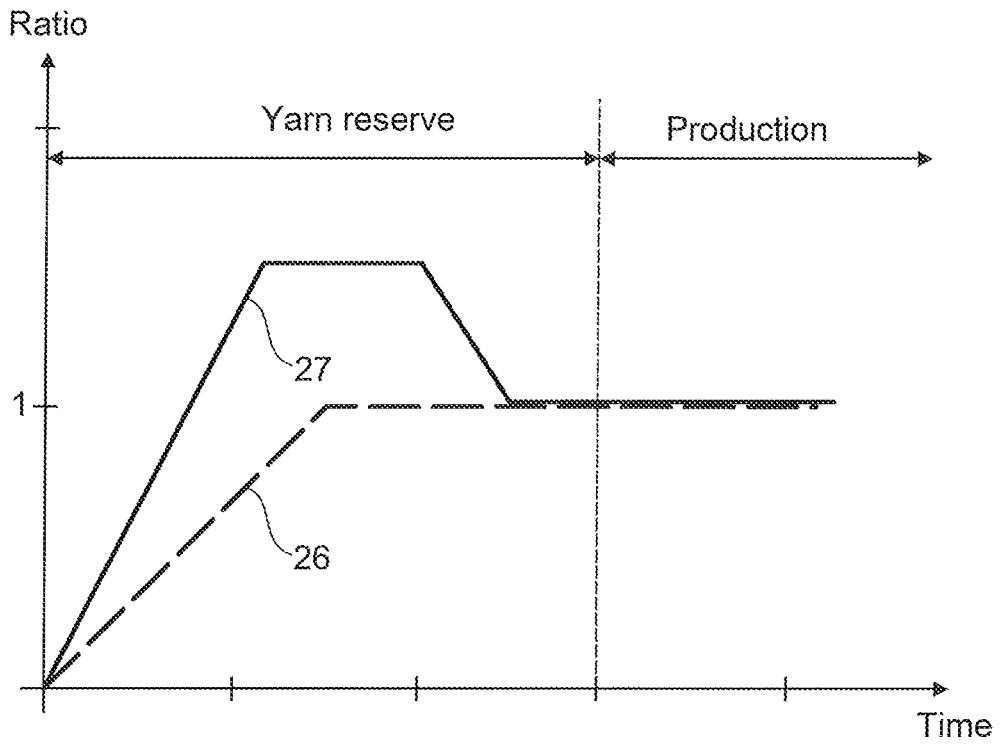
FIG. 2 is a graph of the twists in dependence on the take-up speed of the twist.

FIG. 2 shows the ratio of the actual spindle rotational speed to the production spindle rotational speed and the ratio of the actual take-up speed to the production take-up speed during the start of a spindle 2. While the ordinate scales the ratio, the abscissa is a time axis. The first time span shows the curve during the creation of the yarn reserve, which is followed by the time span of the production. Both the spindle rotational speed and the take-up speed reach a constant value.

Reference sign 26 indicates the ratio of the actual spindle rotational speed to the production spindle rotational speed. The spindle 2 accelerates to the production rotational speed over a certain time period and then remains constant; that corresponds to a ratio of 1. Reference sign 27 indicates the ratio of the actual take-up speed to the production take-up speed. The take-up speed increases and reaches a value that lies above the production take-up speed. In this example, the value corresponds to a ratio of approximately 1.5. During this increased actual take-up speed, the yarn reserve is wound. After a specified time, the actual take-up speed is lowered to the production take-up speed and the yarn guide pivots with the twist 18 into the production region in order to wind the twist 18 under production conditions.

Figure 3:
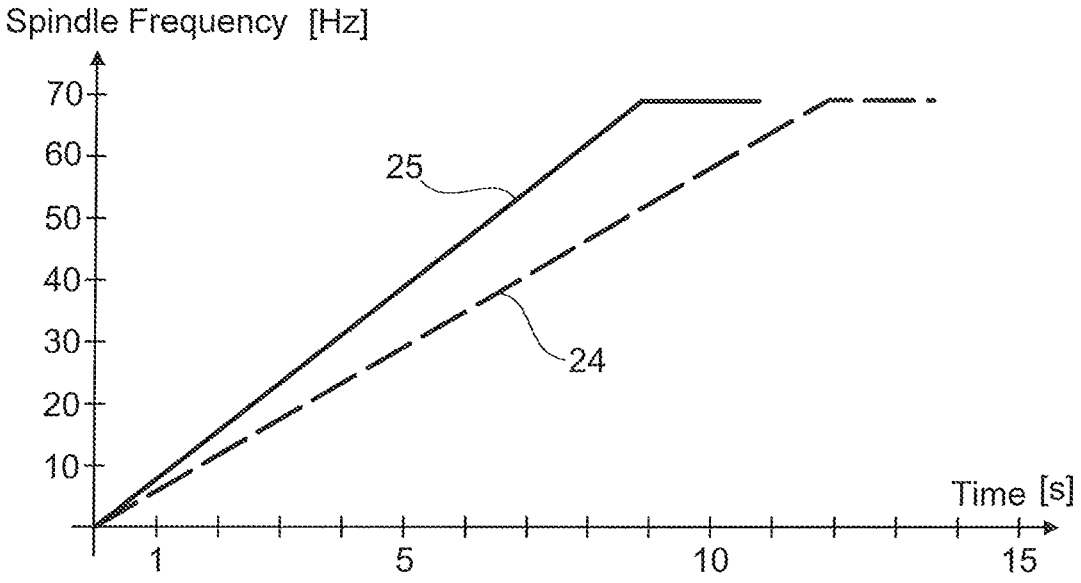
FIG. 3 is a graph of the run-up ramp of the spindle rotor in dependence on the acceleration.

FIG. 3 graphically presents the run-up ramp of the spindle rotor. The spindle frequency is shown on the ordinate. The abscissa scales the time in seconds. Reference number 24 indicates an acceleration that was previously performed during the start of a cabling spindle 2 at the start of a batch or after a restart, for example after a yarn break. The spindle rotor requires approximately 11.7 seconds to reach the operating rotational speed.

In contrast, reference sign 25 indicates an acceleration of the spindle rotor at the start of a new batch that, in this example, occurs 2 Hz*s−1 faster than the previous acceleration. As a result, the spindle rotor has run up to the operating rotational speed already after approximately 8.7 seconds and therefore approximately 3 seconds faster. The faster the spindle rotor is accelerated to the operating rotational speed, the faster the outer yarn 12 forms the yarn balloon B and the less long the outer yarn 12 rubs on the lower and/or upper edge of the spindle pot 5.

Figure 4:
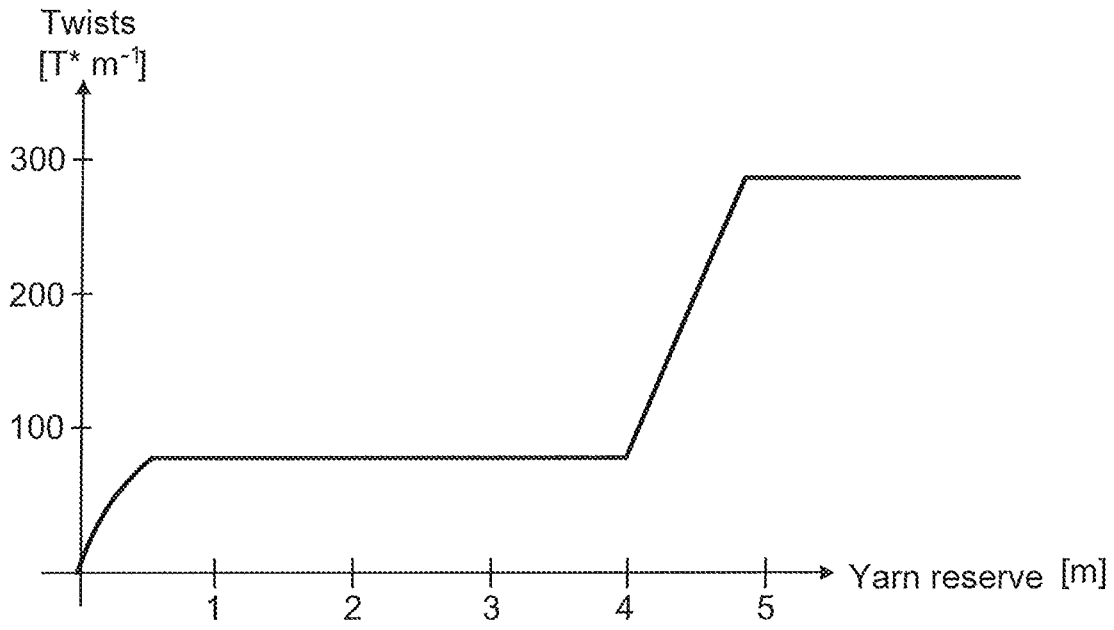
FIG. 4 is a graph of the twists during the creation of the yarn reserve.

FIG. 4 shows the creation of an approximately 5 metre long yarn reserve, before the twist 18 is produced and wound under production conditions. At the start of the winding operation, the number of twists rises to approximately 80 $T*m^{-1}$, and the twist 18 is wound at a high take-up speed. After approximately 4 metres, the take-up speed drops and the twists increase to a specified value of 280 $T*m^{-1}$. After the specified twist and therefore the production speed have been reached, the yarn guide pivots with the twist 18 to be wound into the production region of the take-up package 19 and winds the twist 18 under production conditions.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. A method for starting a spindle of a cabling or two-for-one twisting machine at the start of a spindle journey, wherein the cabling or two-for-one twisting machine has at least one workstation, each workstation having a spindle pot at rest during the twisting for holding a first feed package and having a rotating, hollow spindle rotor with a spindle hollow shaft, which has a lateral outlet opening arranged below the spindle pot at a distance from the spindle hollow shaft, wherein an outer yarn pulled from a second feed package is wound around an inner yarn pulled from the first feed package and wherein the outer yarn is guided through the spindle hollow shaft and through the lateral outlet opening thereof and in a yarn balloon orbiting the spindle pot to a yarn-guiding device, which is arranged above the spindle in extension of a spindle axis and which merges two yarn supplies, and a winding device is present, in which the winding device creates a produced twist that is wound onto a take-up package, characterized in that the method comprising:

creating a yarn reserve on an empty take-up package by using a start-up ratio of a take-up speed of the produced twist to an actual rotation speed of the spindle rotor during start-up conditions, the start-up ratio being greater than a production ratio of a take-up speed of the produced twist to an actual rotation speed of the spindle rotor during production conditions.

2. The method according to claim 1, characterized in that the take-up speed is increased during the creation of the yarn reserve in comparison with the take-up speed during production.

3. The method according to claim 1, characterized in that a run-up of the spindle rotor occurs with at least an acceleration increased by a factor of 1.2 during creation of the yarn reserve.

* * * * *